United States Patent [19]

Greenberger

[11] Patent Number: 4,485,576

[45] Date of Patent: Dec. 4, 1984

[54] MESSAGE DISPLAY SIGN

[75] Inventor: William Greenberger, White Plains, N.Y.

[73] Assignee: The Hopp Press Incorporated, New York, N.Y.

[21] Appl. No.: 130,006

[22] Filed: Mar. 13, 1980

[51] Int. Cl.[3] ..... G09F 11/00

[52] U.S. Cl. ..... 40/491; 40/18; 40/488; 40/490

[58] Field of Search ..... 40/488, 491, 490, 18, 40/17

[56] References Cited

U.S. PATENT DOCUMENTS

| | | | |
|---|---|---|---|
| 2,214,275 | 9/1940 | Hart | 40/491 |
| 3,248,809 | 5/1966 | Stifano | 40/491 X |
| 4,164,824 | 8/1979 | Nidelkoff | 40/488 |
| 4,177,593 | 12/1979 | Lockey | 40/488 |
| 4,217,713 | 8/1980 | Greenberger | 40/491 X |

FOREIGN PATENT DOCUMENTS

| | | | |
|---|---|---|---|
| 441846 | 1/1936 | United Kingdom | 40/491 |

*Primary Examiner*—Gene Mancene
*Assistant Examiner*—Cary E. Stone
*Attorney, Agent, or Firm*—Kane, Dalsimer, Kane, Sullivan & Kurucz

[57] ABSTRACT

A message display sign is provided which includes a first panel having indicia thereon and appropriately shaped and positioned windows or openings therein. A second panel is provided behind the first panel and includes a second set of indicia. When in a first position, a selected portion of the second set of indicia is visible through the openings of the first panel. The visible portion of indicia from the second panel combined with the indicia on the first panel convey a first meaningful message. When in a second position behind the first panel, a second selected portion of the second set of indicia is visible through the openings in the first panel. This second selected portion combined with the indicia on the first panel convey a second meaningful message.

5 Claims, 4 Drawing Figures

MESSAGE DISPLAY SIGN

BACKGROUND OF THE INVENTION

The field of the invention concerns message display signs, and particularly a sign capable of conveying alternative messages.

There are a number of instances where it would be advantageous to employ a sign capable of displaying more than one message in alternative situations. Open/-closed signs, for example, are commonly employed by commercial businesses. An example of such a sign is disclosed in commonly assigned U.S. Pat. No. 4,217,713. Another commercially employed sign includes one side which provides the "Open" message while the other side reads "Closed". The sign is secured to a window in such a manner that it may be flipped to either side.

SUMMARY OF THE INVENTION

The invention is directed to a display sign including a first panel having a first set of indicia thereon and appropriately shaped and positioned openings therein. A second panel is mounted behind the first panel and includes a second set of indicia thereon. The panels are arranged such that when the second panel is in a first position, a first selected portion of the second set of indicia is visible through the openings in the first panel. The visible portion of the indicia from the second panel combined with the indicia on the first panel convey a first meaningful message. When in a second position behind the first panel, a second selected portion of the second set of indicia is visible through the openings in the first panel. This second selected portion combined with the indicia on the first panel convey a second meaningful message.

Means may be provided for allowing one to properly align the two panels with a minimum of time and effort. The panels may be arranged such that the second panel is slidable with respect to the first panel. Stop means may be provided which prevent the second panel from moving too far in either direction and which provide a positive indication that the panels are properly aligned.

DETAILED DESCRIPTION OF THE INVENTION

Figure 1:
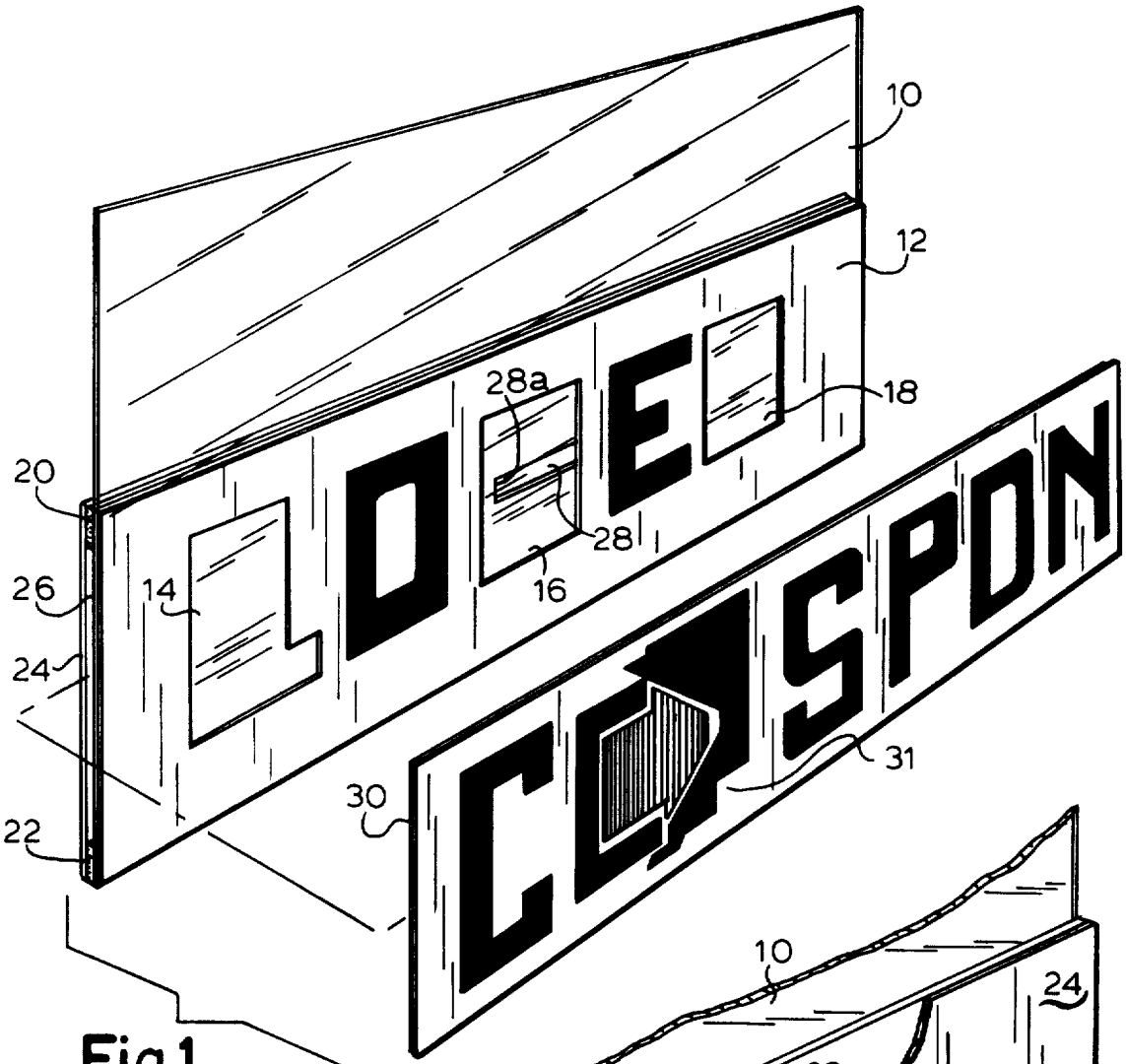
FIG. 1 is an exploded view of the invention.
Figure 2:
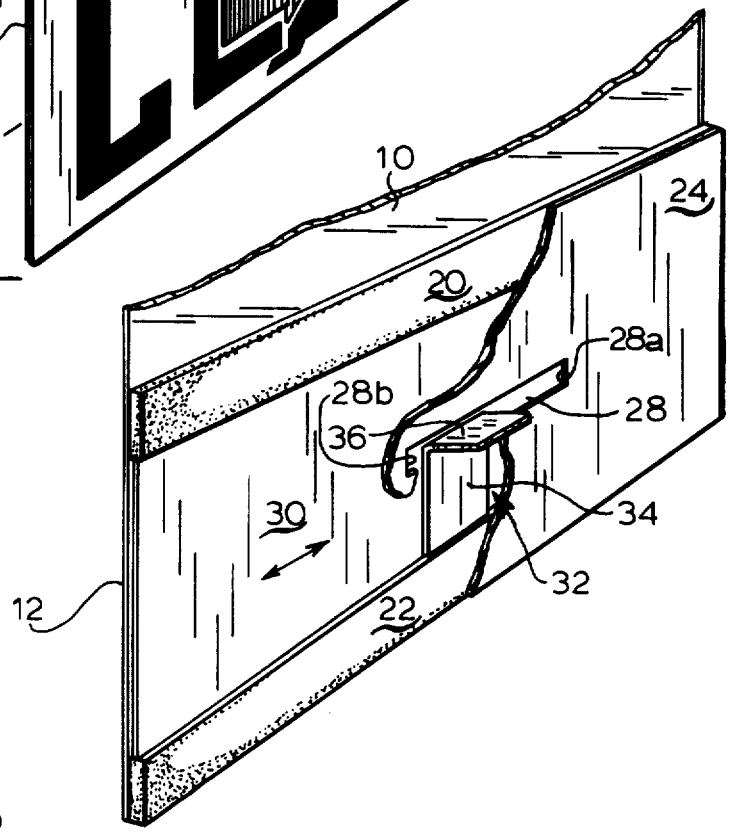
FIG. 2 is a rear perspective view of the invention.

The invention is directed to a sign which is capable of displaying alternative messages. As shown in FIG. 1, the sign includes a first indicia-bearing panel 10 which may be made from a transparent plastic material. The panel includes an opaque rectangular portion 12 which may be formed by coloring the panel appropriately or applying a coating of paper or the like to the surface thereof. Indicia are provided on this opaque portion, and the drawing shows the letters "O" and "E".

A plurality of openings 14, 16 and 18 are provided within the opaque portion. Alternatively, the openings may instead be windows if designated areas of portion 12 are left transparent. Accordingly, the term opening as used herein should be given a broad definition. For reasons which will be apparent, openings 16 and 18 are rectangular while opening 14 is somewhat L-shaped.

A pair of parallel spacing members 20, 22 are bonded to the rear side of the first panel 10. A rear panel 24 is bonded to the opposite side of the spacing members so that a slot 26 is formed between the first and rear panels. The rear panel includes a rectangular opening 28 near the center thereof.

A second indicia-bearing panel 30 is provided for slidable insertion within the slot 26. It has a height corresponding to the distance between the spacing members and a width which may approximate or be somewhat less than the width of the first panel 10.

A set of indicia is provided on the front surface of the second panel. In the panel shown in the drawings, the indicia are (from left to right): the letter "C"; a red arrow having a small shaft, the shaft being surrounded by a C-shaped black portion, the point of the arrow surrounded by an irregularly shaped polygon having a V-shaped portion corresponding to the arrow head and a notch 31 in its lower right corner; and the letters "S", "P", "D" and "N". The letters of both the first and second panels are black, the background of the letters being white. Other colors may be employed if so desired. The indicia of both panels are arranged in straight horizontal lines.

An L-shaped member 32 is secured near the center of the reverse side of the second panel 30. One portion 34 is glued to the panel while the second portion 36 extends perpendicularly therefrom. To facilitate the assembly of the sign, the second panel may be positioned before the rear panel. The rectangular opening 28 within the rear panel is located such that the second portion 36 of member 32 will extend therethrough. Portion 36 may accordingly be used as a handle for moving the second panel back and forth within the slot 26.

Figure 3:
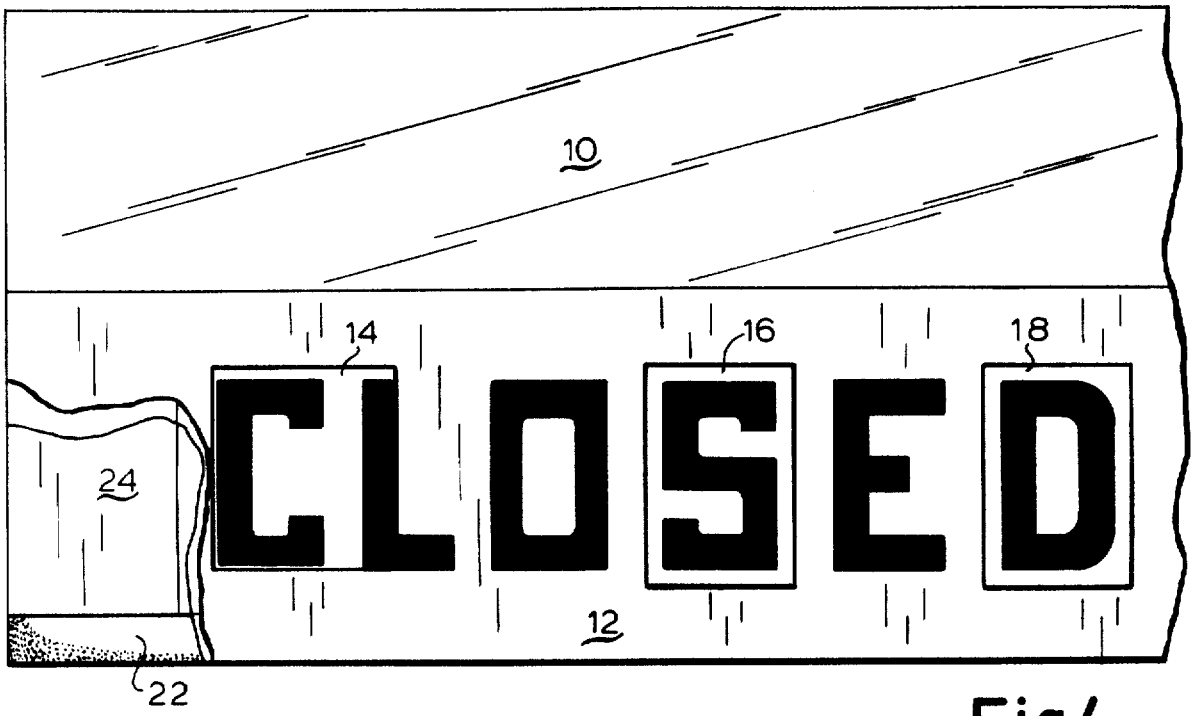
FIG. 3 is a front view of the invention when arranged in one position.
Figure 4:
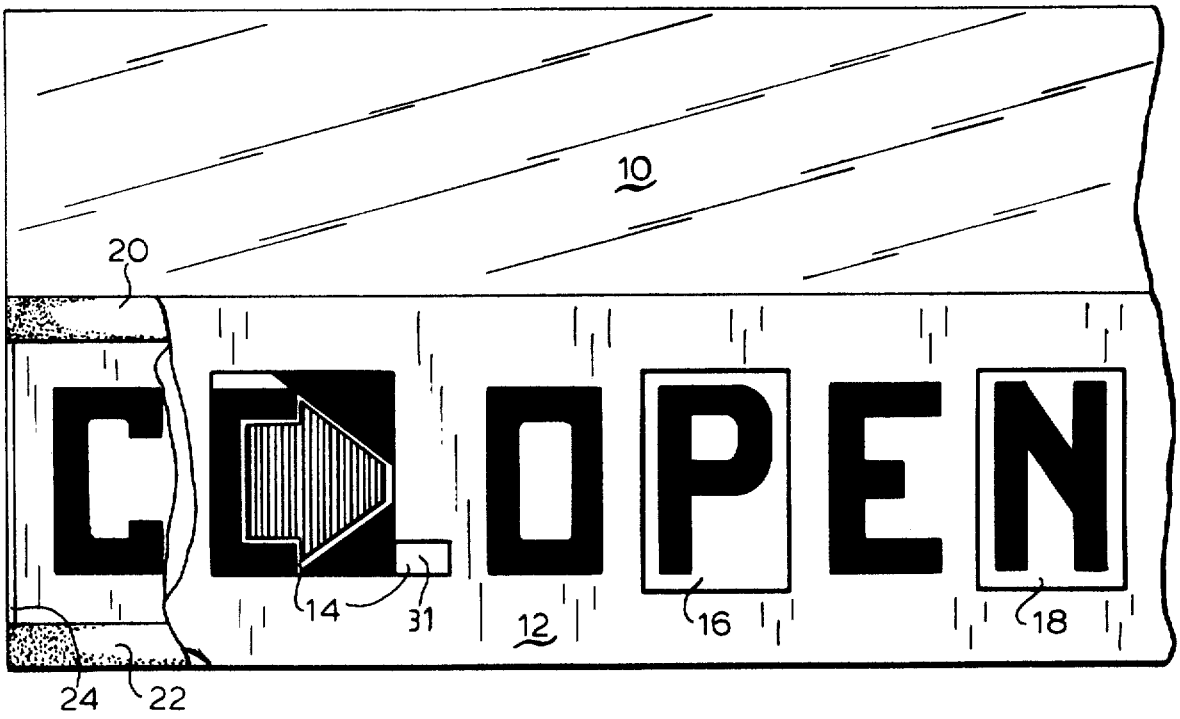
FIG. 4 is a front view of the invention when arranged in another position.

The letters and openings within the first and second indicia-bearing panels are arranged such that the sign may be employed as shown in FIGS. 3 and 4. The words "OPEN" and "CLOSED" both include the letters "O" and "E" separated by a third letter. Accordingly, the first panel 10 includes the letters "O" and "E" separated by a rectangular opening 16. Since both of these words also have another letter following the letter "E", the second rectangular opening 18 is provided in panel 10.

The sign must be arranged such that when the "P" and the "N" are positioned behind openings 16 and 18, respectively, the word "OPEN" is readable. As shown in FIG. 4, the red arrow together with its black background draw attention to the fact that the sign reads "OPEN". The notch 31 in the black background will be opposite the small extension of opening 14 which gives it its "L" shape. By making the background of the indicia of both panels the same color, there will be no irregularity in the design of the arrow.

When the "S" and the "D" are in registry with openings 16 and 18, respectively, the sign reads "CLOSED" as shown in FIG. 3. The letter "C" will be in registry with opening 14 while the letter "L" is formed by two straight portions of the C-shaped black portion surrounding the shaft of the arrow. The arrow and the remainder of its background are occluded by the letter "O". Similarly, the letters "P" and "N" of the second panel are occluded by the letter "E" and the right hand part of opaque portion 12.

The opening 28 in the rear panel 24 and the protruding portion 36 of L-shaped member 32 are advantageously formed and positioned to positively indicate when the panels 10 and 30 are aligned to read "OPEN" or "CLOSED". When the second panel is moved to one extreme position where the protruding portion 36 contacts one edge 28*a* of the opening 28, the sign will read "OPEN". When the edge 28*b* opposite 28*a* is contacted, the sign reads "CLOSED". The sign may accordingly be mounted to the interior of a window with the message-bearing side facing outside. Adjustment of the sign may be conducted without the need for observing whether the panels are properly aligned.

It will be appreciated that the invention as described herein may be modified without departing from the spirit of the invention. The scope of the invention should accordingly be determined by reference to the appended claims.

I claim:

1. A message displaying sign comprising:

a first indicia-bearing panel including consecutively, a first opening, the letter "O", a second opening, the letter "E", and a third opening;

a second indicia-bearing panel positioned adjacent to said first panel and movable with respect thereto, said second panel being movable at least between a first position wherein a first set of indicia of said second panel is visible through said openings in said first panel such that the combined indicia of both panels convey the word "OPEN", and a second position such that the combined indicia of both panels convey the word "CLOSED", wherein said second panel indicia includes, consecutively, the letter "C", and arrow and a background for said arrow, and the letters "S", "P", "D", and "N", said second panel indicia being arranged in a straight line, said first panel indicia being arranged in a straight line, said first opening having a generally rectangular configuration with a small lateral extension giving it an "L" shape, said first and second panels arranged such that when in the first position, the arrow and its background are seen through said first opening, said small lateral extension exposing an area of the second panel of the same color as the non-indicia bearing portions of the first panel, and when said first and second panels are in the second position, the letters "CL" are visible through said first opening; and means for mounting said panels such that said second panel is movable with respect to said first panel.

2. A sign as defined in claim 1 wherein said mounting means is a third panel secured to said first panel in such a manner that a slot exists between said first and third panels, said second panel being positioned in said slot and slidable therein.

3. A sign as defined in claim 2 wherein said third panel has an opening therein and said second panel has a protrusion extending through said opening in said second panel, said second panel being actuable by manipulating said protrusion.

4. A sign as defined in claim 3 wherein said opening in said third panel has a length defined by a pair of opposing edges, said second panel being in said first position when said protrusion is in contact with one of said opposing edges and in said second position when said protrusion is in contact with the other of said opposing edges.

5. A sign as defined in claim 1 including means for stopping the movement of said second panel at said first and second positions.

* * * * *